US005551895A

United States Patent [19]

Calbi

[11] Patent Number: 5,551,895

[45] Date of Patent: Sep. 3, 1996

[54] 3-LEVEL FLUORESCENT LIGHT ADAPTER

[75] Inventor: Domenick Calbi, Denver, Colo.

[73] Assignee: Domenick A. Calbi, Denver, Colo.

[21] Appl. No.: 384,649

[22] Filed: Mar. 27, 1995

[51] Int. Cl.[6] ..... H01R 25/00

[52] U.S. Cl. ..... 439/642; 439/236; 362/227

[58] Field of Search ..... 439/226, 236, 439/638, 642–646; 362/226, 227

[56] References Cited

U.S. PATENT DOCUMENTS

| | | | |
|---|---|---|---|
| 1,600,564 | 9/1926 | Propp | 439/643 |
| 3,815,080 | 6/1974 | Summa | 439/646 |
| 4,835,748 | 5/1989 | Krause, Jr. | 439/643 |
| 5,186,659 | 2/1993 | Hefner | 439/643 |
| 5,286,216 | 2/1994 | Volz | 439/236 |
| 5,320,548 | 6/1994 | Schadhauser | 439/236 |
| 5,362,246 | 11/1994 | Lau | 439/236 |
| 5,428,514 | 6/1995 | Jung | 439/236 |

FOREIGN PATENT DOCUMENTS

| | | | |
|---|---|---|---|
| 553181 | 5/1923 | France | 439/644 |

*Primary Examiner*—Gary F. Paumen
*Assistant Examiner*—Jill DeMello

[57] ABSTRACT

The adapter has a 3-contact medium base. Two "hot" or phase conductor contacts, black wires, and a neutral screw shell with two leads, white wires. A black and a white wire is connected to one medium base lampholder, and a black and white wire is connected to the second medium base lampholder. The lampholders are attached to the main body with extension arms made of flexible steel. Steel locknuts and nipples connect the arms to the main body and the lampholders to the arms.

The main body is made of plastic with the 3-contact medium base at the end. Wires in the main body come out the top to the two lampholders that would hold compact fluorescent lamps.

1 Claim, 1 Drawing Sheet

3-LEVEL FLUORESCENT LIGHT ADAPTER

SUMMARY OF THE INVENTION

The primary purpose of this invention is to obtain three levels of fluorescent light from a floor lamp or table lamp. This adapter will screw into a floor lamp having a 3-way medium base lampholder. Turning the switch of the floor lamp will send current to one medium base lampholder having a 15 watt compact fluorescent lamp. Turning the switch again will send current to a second medium base lampholder having a 20 watt compact fluorescent. The 15 watt compact fluorescent is not on in this position of the switch. Turning the switch again, current will go to both medium base lampholders having compact fluorescent lamps. Three levels of fluorescent light is obtained. The fluorescent lamps suggested are compact type that measure 2¼ inch wide, 6⅞ inch high, which replaces 40 and 60 watt incandescent bulbs.

DETAILED DESCRIPTION

A disadvantage of a compact fluorescent when used in floor or table lamp with a 3-way switch is that it works at one light level. With this adapter you can Send current to one compact fluorescent and then to the other Compact fluorescent and to both at the same time. Using two different wattages of compact fluorescent bulbs, you can obtain three levels of light.

Figure 1:
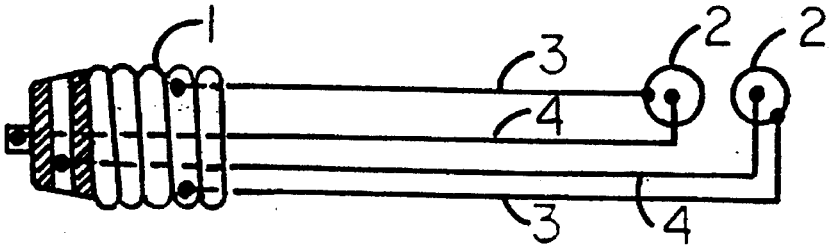
FIG. 1 is a schematic illustrating the contacts of the 3-contact medium base and wires going to the two lampholders.

FIG. 1 illustrates the contacts of the 3-contact medium base 1, the black wires 4 and white wires 3 going to the two lampholders 2, where compact fluorescent lamps would be used.

Figure 2:
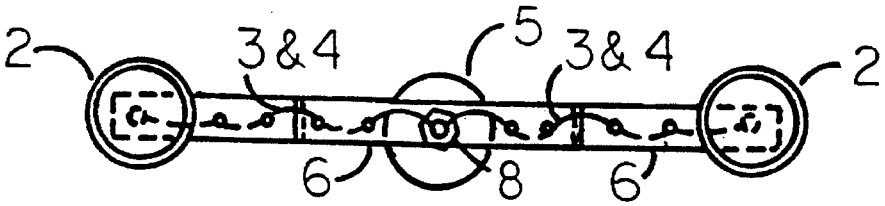
FIG. 2 is a top view illustrating the arrangement of the main body, the arms, and the two lampholders.
Figure 3:
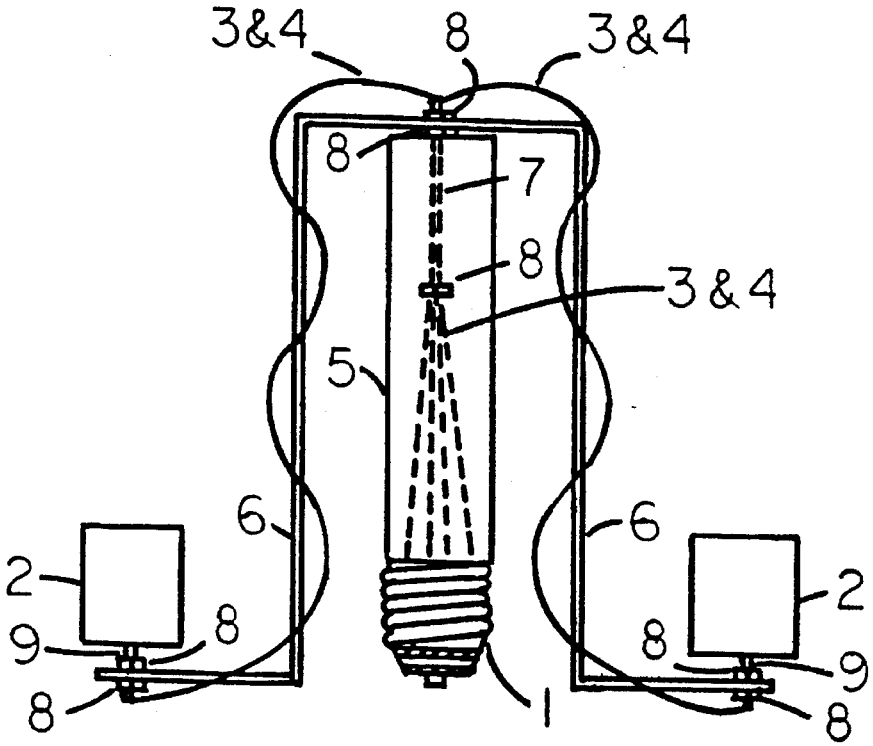
FIG. 3 is an elevation of the adapter illustrating the arrangement of the main body, the arms, the two lampholders, and wires going to them.

FIG. 2 and 3 illustrates that the main body 5, made of plastic, is connected to the arms 6 with a 2 inch long steel nipple 7 and locknuts 8. The arms 6 are made of flexible steel. Connected to the arms 6 are the two lampholders 2. The lampholders 2 are connected with steel nipple 7 and locknuts 8. The wires 3 and 4 going to the lampholders are insulated copper conductors fixture wire.

What is claimed:

1. A device adapted to be connected to a 3-way lampholder having a switch, said device comprising:

a 3-contact male base (1) with a tip contact phase wire (4), a ring contact phase wire (4), and two screw shell neutral wires (3);

said tip contact phase wire (4) and one of said screw shell contact neutral wires (3) electrically connected to a first lampholder;

said ring contact phase wire (4) and the other screw shell contact neutral wire (3) electrically connected to a second lampholder;

a main body (5) made of a rigid insulative material attached to said 3-contact male base;

said phase and neutral wires extending through said main body, and through a steel nipple (7) located within said main body; and arms (6) made of flexible steel connecting said main body to said lampholders;

wherein, said lampholders can be energized separately or together depending on a position of said switch.

* * * * *